United States Patent [19]

Bakx

[11] Patent Number: 4,741,728

[45] Date of Patent: May 3, 1988

[54] FOLDING METHOD AND APPARATUS FOR BASKET-STYLE ARTICLE CARRIERS

[75] Inventor: Martinus C. M. Bakx, Roosendaal, Netherlands

[73] Assignee: The Mead Corporation, Dayton, Ohio

[21] Appl. No.: 19,410

[22] Filed: Feb. 27, 1987

[30] Foreign Application Priority Data

Feb. 27, 1986 [GB] United Kingdom ..... 8604923

[51] Int. Cl.[4] ..... B31B 3/36; B31B 3/62

[52] U.S. Cl. ..... 493/131; 493/136; 493/138; 493/140; 493/178; 493/912

[58] Field of Search ..... 493/128, 130, 131, 136, 493/137, 138, 139, 140, 178, 912

[56] References Cited

U.S. PATENT DOCUMENTS

| | | | |
|---|---|---|---|
| 2,623,683 | 12/1952 | Ringler | 493/128 |
| 2,639,648 | 5/1953 | Fahey | 493/138 |
| 3,656,417 | 4/1972 | Scully | 493/131 |
| 4,056,046 | 11/1977 | Hughes | 493/128 |
| 4,062,270 | 12/1977 | Culpepper | 493/137 |
| 4,319,878 | 3/1982 | Dozier et al. | 493/131 |

FOREIGN PATENT DOCUMENTS

| | | | |
|---|---|---|---|
| 0016514 | 10/1980 | European Pat. Off. | 493/912 |
| 1331357 | 5/1963 | France | 493/139 |

*Primary Examiner*—Frederick R. Schmidt
*Assistant Examiner*—William E. Terrell
*Attorney, Agent, or Firm*—Erwin Doerr

[57] ABSTRACT

A method of forming a basket-style carrier in which a securing strip (16*d*) provided at a free end portion of a base panel (16) of the carrier is inserted into a space (42) created between a side wall (14*a*) and partition panels (14*d*) associated therewith so that the securing strip is secured to an inner face of that side wall internally of the carrier.

3 Claims, 2 Drawing Sheets

FOLDING METHOD AND APPARATUS FOR BASKET-STYLE ARTICLE CARRIERS

This invention relates to a method and apparatus for folding an article carrier of the so-called basket type by which an edge portion of the base panel of such a carrier is secured to an internal face of a side wall of the carrier.

Normally a basket-type article carrier has a base panel which includes an edge portion comprising a securing strip of material hinged to an adjacent part of the base panel and to which glue is applied. During folding of the carrier blank to form the article carrier in collapsed condition the base panel is folded about a central fold line and the securing strip brought into overlapping relationship and secured to the external surface of a side wall of the carrier. Thus, the securing strip is exposed to view, interrupts the continuous external surface of the side wall and therefore can detract from the printed appearance of the carrier side wall. Such an article carrier is disclosed in European Pat. No. 0,016,514 the disclosure of which is hereby incorporated by reference.

The present invention seeks to improve the appearance of a basket-style article carrier by a modified folding and gluing process in which the securing strip is secured to an internal face of a carrier side wall and hidden from view.

The invention provides a method of forming a basket-style article carrier from a partially formed carrier in collapsed condition which includes a first carrier part comprising one side wall of the carrier and internal partition panels associated therewith and a second carrier part comprising an opposite side wall of the carrier and internal partition panels, associated therewith, the carrier further inclduing a base panel and a securing strip provided by the base panel associated with the first carrier part which method comprises moving the partially formed carrier along a feed path in which the first and second carrier parts intitially are disposed substantially in the plane of the feed path, characterised by folding said second carrier part across said feed path towards said first carrier part and folding said base panel together with said securing strip in an opposite direction across said feed path towards said second carrier part and manipulating said second carrier to move into superposed relationship with said first carrier part and so that a space is created between said opposite side wall and the internal partition panels associated therewith, causing the securing strip to be inserted into said space while said securing strip and said second carrier part are in a raised attitude and thereafter causing the securing strip to be adhered to an inner face of said opposite wall while the completed carrier is in flat collapsed condition.

Figure 1:
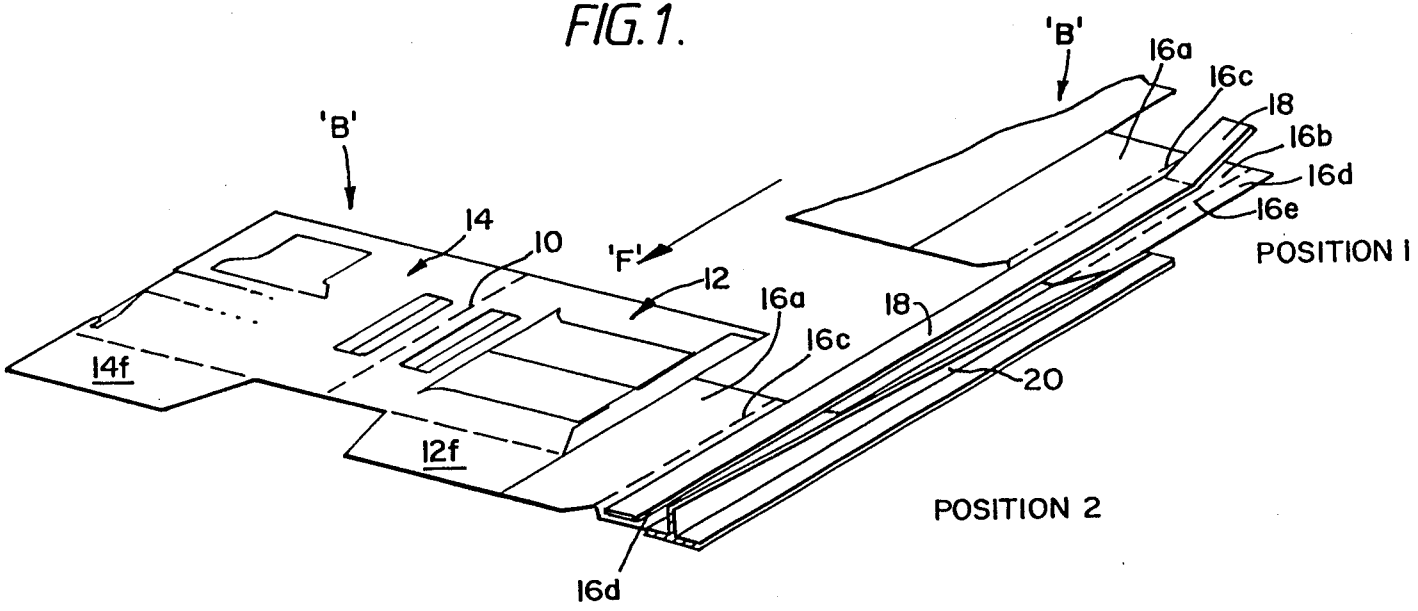
Figure 2:
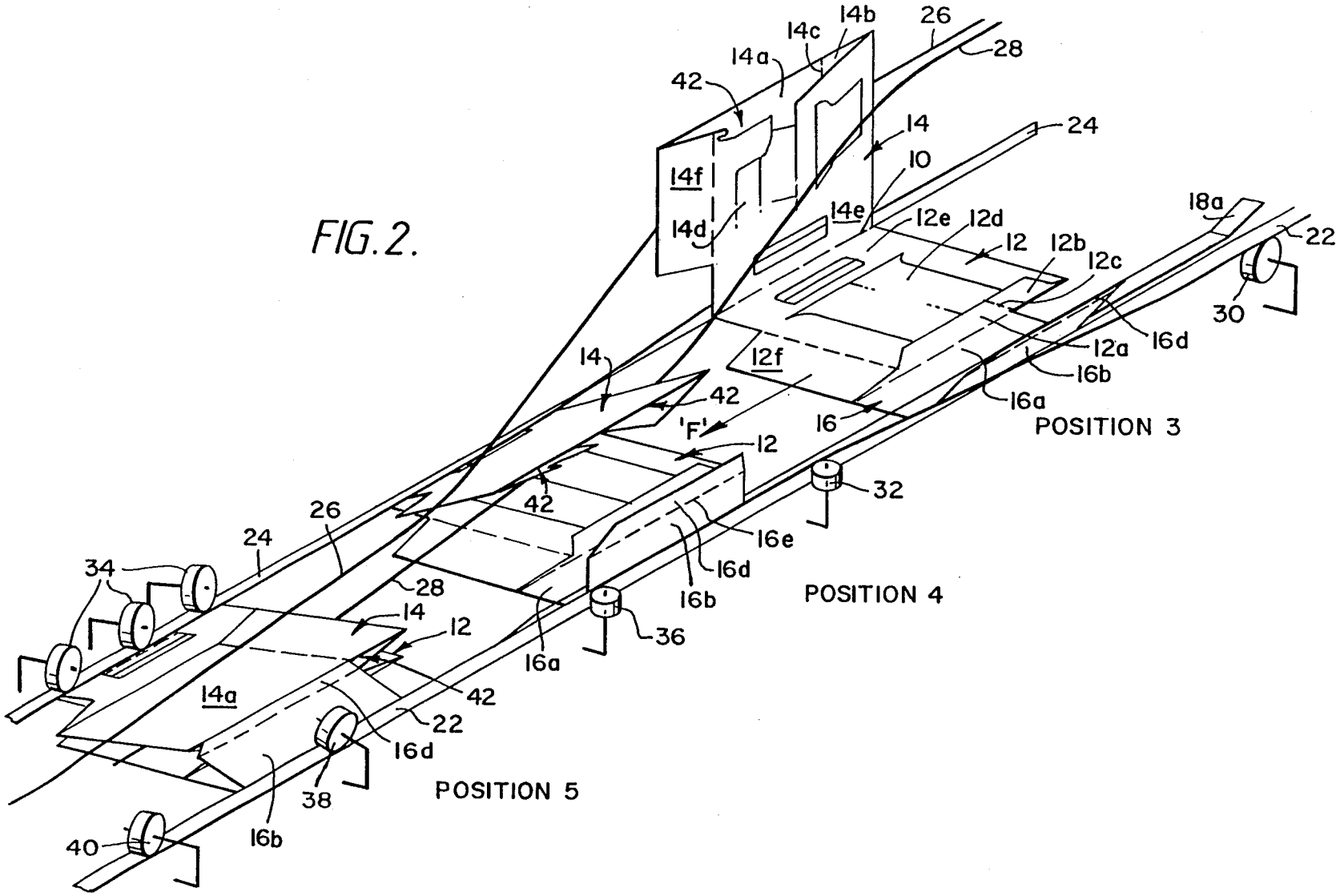

An embodiment of the invention will now be described, by way of example, with reference to the accompanying drawings, in which:

FIG. 1 shows schematically components in a feed path of a folding and gluing machine for effecting an initial folding operation of a part-formed article carrier; and FIG. 2 shows schematically further components of the machine in the feed path for effecting further folding operations on the part-formed carrier.

In FIGS. 1 and 2, a partially formed carton blank 'B' for forming a carton of the basket-type is conveyed along a feed path 'F' and subjected to sequential operations in a continuous folding and gluing process. For the purpose of this description only those parts of the carton relevant to the fabricating process of this invention are identified and described but the reader's attention is directed to the aformentioned European Pat. No. 0,016,514.

In FIG. 1, the partially formed carton blank is shown already formed into a condition in which is comprises a pair of similar parts relative to a central fold line 10 of the blank. For simplicity, these parts will be referred to as lower part 12 and upper part 14. The lower part carries a base panel 16 of the carrier which constitutes the major difference between the upper and lower parts.

Lower part 12 comprises a side wall panel **12*a* to which is hinged an end wall panel 12*b* of one end of the carton about fold line 12*c*. Likewise, upper part 14 comprises the opposite side wall panel 14*a* of the carton to which is hinged an end wall panel 14*b* of the same one end of the carton about fold line 14*c*. Superimposed upon the side and end wall panels of the lower part 12 are a number of further carton panels which include transverse and medial partition panels generally depicted by reference numeral 12*d*, handle structure 12*e* and an end wall panel 12*f* of the opposite end of the carton. Similarly, superimposed upon the side and end wall panels of the upper part 14 are a number of carton panels which include transverse and medial partition panels generally depicted by reference numeral 14*d*, handle structure 14*e* and an end wall panel 14*f*** of the said opposite end of the carton.

The base panel 16 comprises panel portions **16*a* and 16*b* integrally hinged about an intermediate fold line 16*c* and a securing strip panel 16*d* hinged integrally to base panel portion 16*b* about fold line 16*e***.

Referring now specifically to FIG. 1, the part-formed carton blank 'B' is shown schematically in position 1 at which all the panels are lying substantially flat in a horizontal panee, the blank being conveyed in the direction of feed path 'F'. Within the feed path between positions 1 and 2, a flat elongate guide strip 18 is disposed such that it overrides the base panel portion **16*b* but is clear of the securing strip 16*d* of the carton. A folding bar 20 is provided alongside guide strip 18 so that the securing strip of the base panel is directed between guide strip 18 and folding bar 20. The folding bar 20 is shaped so as to fold the securing strip upwardly about fold line 16*e* out of the plane of the remainder of the base panel during forward movement of the blank. This initial folding step raises the securing strip to an extent such that an obtuse angle is subtended between the securing strip 16*d* and base panel portion 16*b* which facilitates a subsequent folding operation described later. The blank has now moved through positions 1 and 2 of FIG. 1**.

Referring now specifically to FIG. 2, path feed "F" is flanked by a pair of movable parallel endless belts 22, 24 respectively, which move in synchronism with a carton in the feed path. Intermediate the parallel belts are a flat elongate guide strip **18*a* (which can be an extension of strip 18) adjacent belt 22 and a pair of fixed folding bars 26, 28 respectively, adjacent belt 24. Immediately prior to position 3 illustrated, the upper part 14 of the carton enters the space between the folding bars while in a horizontal plane. The folding bars are shaped so that by the time the carton reaches position 3, the upper part 14 progressively has been raised by folding about central fold line 10 into an upright attitude relative to lower part 12**.

Guide strip 18*a* is positioned so as to bear against base panel portion 16*a* while base panel portion 16*b* is disposed between strip 18*a* and belt 22. At each of the upstream and downstream ends of position 3 a roller 30 and 32, respectively is located which bear against belt 22. Roller 30 is set with its axis of rotation horizontal whereas the axis of rotation of roller 32 is vertical thereby to maintain a twist in the belt from a horizontal to a vertical plane between positions 3 and 4. Thus, as the base panel portion 16*b* moves along the space between guide strip 18*a* and belt 22 it is folded upwardly about fold line 16*c* into an upright attitude at position 4.

The opposing belt 24 however is in an upright attitude through position 3 and located against upper part 14 of the carton adjacent fold line 10. Also between positions 3 and 4, folding bars 26 and 28 extend downwardly and transversely of the feed path while also gradually becoming more closely spaced together. At position 3 an application of glue is made to specific areas of the panels 12*d*, 12*e*, and 12*f*, as is well known in the art.

The orientation of the folding bars causes the upper part 14 of the carton to fold downwardly about fold line 10 towards the horizontally disposed lower part 12 as the carton moves from position 3 to position 4. Belt 24 is twisted out of a vertical plane at position 3 into a horizontal plane at positions 4 and 5, the twist being maintained by a set of in-line rollers 34 at position 5. The rollers of set 34 all have their axes of rotation in a horizontal plane with the rollers bearing downwardly onto belt 24. As a result of the twist, induced by roller set 34, belt 24 remains in a similar position in relation to the upper portion 14 of the carton even though the upper portion is folded downwardly during transfer from position 3 to position 4 because the belt 24 is caused to adopt a more horizontal position between positions 3 and 4. Thus belt 24 applies pressure in a direction towards the feed path onto the fold line 10 which tends to move apart the side wall 14*a* and end wall 14*b* from the adjacent internal partition panels 14*d* provided that the upper carrier part 14 is supported by folding bar 28 at a location spaced from the free end of the carton part 14 so that a space 42 is created between side wall 14*a* and the adjacent internal partition panels 14*d*. If necessary, an appropriate folding element (now shown) may be introduced between side wall 14*a* and the adjacent internal partition panels 14*d* to prise those panels apart and encourage the creation of space 42.

Belt 22 is maintained vertical throughout position 4 by the cooperation of roller 32 and a further roller 36 disposed at the downstream end of position 4 at which location the guide strip 18*a* terminates. Thereafter, belt 22 again is twisted progressively into a horizontal plane through position 5 by spaced rollers 38 and 40 the former having its axis of rotation inclined to the horizontal while the latter has its axis of rotation disposed in a horizontal plane. This second twist in belt 22 causes base panel portion 16*b* together with integral securing strip 16*d* to be folded downwardly and inwardly relative to the feed path between positions 4 and 5. The downward and inward folding of base panel portion 16*b* is accompanied by like folding of the upper part 14 of the carton. This is achieved by the continuous convergence and transverse deflection of the folding bars 26, 28 until the folding bars are almost in superposed relationship centrally of the feed path at position 5. Here fold bar 28 extends beneath the folded over upper part 14 of the carton while fold bar 28 extends above upper carton part 14. Fold bar 28 terminates at the downstream end of position 5. An application of glue is made to the outer exposed face of the securing strip during its passage through position 4. Thereafter, as the upper part 14 and the securing strip are folded downwardly towards one aother their folding paths interfere such that securing strip 16*b* is inserted into the space 42 present between the adjacent edge of side wall 14*a* and the underlying transverse and medial partition panels 14*d*. This occurs during transference of the carton from position 4 to position 5. Insertion of the securing strip 16*b* is facilitated first in that the pre-folding earlier referred to puts the securing strip into substantially coplanar relationship with side wall 14*a* immediately prior to insertion of the strip into space 42 and secondly in that the leading edge of the securing strip is backwardly raked to avoid snaring of the panels. It will be seen that throughout position 5, fold line 10 at the handle area of the carton and fold line 16*c* at the base panel of the carton run beneath roller sets 34 and 38/40. These rollers momentarily hold upper part 14 and base panel 16*b* in a mutually elevated attitude by virtue of a piercer-like effect which is created by the downward force of the roller sets. As the carton passes through position 5, upper part 14 and base panel 16*b* are lowered together and in so doing move towards one another so that securing strip is fully and smoothly inserted into the space 42. The carton subsequently passes through compression rollers so that all the glued areas are firmly adhered including the adhesion of the securing strip 16*d* to the inner face of side wall 14*a*.

What is claimed is:

1. A method of forming a collapsed basket-style carrier from a partially assembled blank which includes first and second carrier parts comprising first and second side walls, first and second internal partitions associated with said first and second side walls, respectively, and overlying the respective interior surfaces thereof, first and second handle structures extending from said first and second internal partitions, respectively, and being joined along a central fold line, a bottom panel foldably joined to said first side wall and extending in a direction opposite to said first handle structure having an intermediate fold line substantially parallel with said central fold line, and a securing strip foldably joined to said bottom panel remote from said intermediate fold line, which method comprises the steps of moving said partially assembled blank along a feed path with said first and second carrier parts initially disposed in a horziotnal plane and said central fold line and said intermediate fold line extending in the direction of said feed path, folding said second carrier part along said central fold line in a direction transverse to said feed path and toward said first carrier part, folding said bottom panel about said intermediate fold line toward said second carrier part, temporarily holding said second carrier part in an inclined position spaced from said first part so that said second partition separates from said second side wall and a space is formed therebetween, applying adhesive to the exposed surface of said securing strip, causing said securing strip to enter the space between said second side wall and the partition associated therewith, thereafter moving said second carrier part downwardly into overlying relationship with said first carrier part and applying pressure to said second carrier part so that said securing strip is adhered to the interior surface of said second side wall.

2. The method according to claim 1, further including the step of applying pressure to said handle structures along said central fold line after said second carrier part has been folded toward said first carrier part whereby said second carrier part is maintained in said inclined position.

3. The method according to claim 1, wherein adhesive is applied to selected areas of said first carrier part prior to folding said second part toward said first carrier part.

* * * * *